US006631698B1

(12) United States Patent
Hyppänen et al.

(10) Patent No.: US 6,631,698 B1
(45) Date of Patent: Oct. 14, 2003

(54) CIRCULATING FLUIDIZED BED REACTOR

(75) Inventors: Timo Hyppänen, Karhula (FI); Kari Kauppinen, Varkaus (FI)

(73) Assignee: Foster Wheeler Energia Oy, Helsinki (FI)

( * ) Notice: Subject to any disclaimer, the term of this patent is extended or adjusted under 35 U.S.C. 154(b) by 0 days.

(21) Appl. No.: 10/129,183

(22) PCT Filed: Nov. 9, 2000

(86) PCT No.: PCT/FI00/00974

§ 371 (c)(1),
(2), (4) Date: Sep. 5, 2002

(87) PCT Pub. No.: WO01/35020

PCT Pub. Date: May 17, 2001

(30) Foreign Application Priority Data

Nov. 10, 1999 (FI) ..... 19992419

(51) Int. Cl.[7] ..... B09B 3/00

(52) U.S. Cl. ..... 122/4 D; 165/104.16; 110/347

(58) Field of Search ..... 122/4 D, 34, 488, 122/489; 165/104.16; 110/347, 245, 348; 422/145, 147

(56) References Cited

U.S. PATENT DOCUMENTS

| | | | | |
|---|---|---|---|---|
| 4,716,856 A | | 1/1988 | Beisswenger et al. | 122/4 |
| 4,951,612 A | | 8/1990 | Gorzegno | 122/4 |
| 4,969,930 A | * | 11/1990 | Arpalahti | 48/187 R |
| 5,242,662 A | * | 9/1993 | Toth | 422/142 |
| 5,269,262 A | | 12/1993 | Salonen | 122/4 |
| 5,281,398 A | | 1/1994 | Hyppanen et al. | 422/147 |
| 5,341,766 A | | 8/1994 | Hyppanen | 122/4 |
| 5,526,775 A | | 6/1996 | Hyppänen | 122/235.11 |
| 5,601,039 A | | 2/1997 | Hyppänen | 110/245 |
| 5,809,912 A | * | 9/1998 | Hansen et al. | 110/347 |
| 6,269,778 B1 | * | 8/2001 | Anderson et al. | 122/4 D |

FOREIGN PATENT DOCUMENTS

| | | |
|---|---|---|
| EP | 0 082 673 | 12/1982 |
| WO | WO 01/35020 A1 | 5/2001 |

* cited by examiner

*Primary Examiner*—Gregory Wilson
(74) *Attorney, Agent, or Firm*—Fitzpatrick, Cella, Harper & Scinto

(57) ABSTRACT

A circulating fluidized bed reactor includes a furnace, defined by a substantially vertical and planar first wall, and a particle separator having a return duct adjacent to the first wall. In the lower part of the return duct is arranged a gas seal adjacent to a planar tube wall, which wall is the planar wall or a wall defining a space in gas flow connection with the furnace. The width of the horizontal cross section of the lower part of the return duct, measured in the direction of the first wall, is larger than its depth, measured perpendicular to the width. The gas seal includes a seal structure that includes water tubes bent from the tube wall.

17 Claims, 7 Drawing Sheets

CIRCULATING FLUIDIZED BED REACTOR

BACKGROUND OF THE INVENTION

The present invention relates to a circulating fluidized bed reactor in accordance with the pending claims.

In more detail, the invention relates to a circulating fluidized bed reactor, comprising a furnace, the lower part of which is provided with fluidizing gas nozzles for fluidizing bed material to be fed to the furnace, said furnace being defined by a substantially vertical and planar first wall; a particle separator for separating bed material from the gas discharged from the reactor; a return duct for bed material separated in the particle separator, arranged in connection with said first wall and having a lower part; a gas seal arranged in the lower part of the return duct, preventing gas from flowing from the furnace to the return duct; and a receiving space defined by a planar water tube wall, which receiving space may be said furnace, whereby the water tube wall is the first wall, or a space in gas flow connection with the furnace.

It is generally known to manufacture a gas seal of a loop seal type, an L-seal or a seal pot for the return duct of a circulating fluidized bed reactor. In all these cases, the return duct of the separator comprises a duct or a section filled with bed material circulating from the particle separator to the furnace, thus preventing furnace gas from flowing via the return duct to the separator. In conventional separator arrangements, the return duct is uncooled and apart from the furnace wall, wherefore, it has also been natural to arrange the gas seal to be an uncooled construction spaced apart from the furnace wall. It is inevitable, however, that joining uncooled structures to a cooled furnace results in temperature differences and thermal stresses reducing the durability and reliability of the equipment.

Published European patent document 0 082 673 discloses an uncooled gas seal vessel integrated in the wall of the lower part of an uncooled furnace. However, the disclosed arrangement is heavy, extending considerably far from the furnace, and, therefore, needs to be thoroughly supported. Furthermore, uncooled structures can easily get broken due to temperature differences, especially during the start-up and shutdown of the reactor.

U.S. Pat. No. 4,951,612 discloses a fluidized bed boiler having four separate gas seals integrated in the cooled outer wall of a cylindrical furnace. The structure of the gas seals is, however, not illustrated in detail.

U.S. Pat. No. 5,269,262 discloses a cylindrical fluidized bed boiler, having a cylindrical structure in the middle thereof, said structure comprising a particle separator, return duct and a multipart, partly cooled gas seal. In the given arrangement, the durability of the furnace wall reduces considerably at the return openings for circulating material and the wide solid wall surfaces between the openings interfere with the even distribution of the material in the furnace.

U.S. Pat. No. 5,281,398 discloses a new kind of a cooled particle separator for a circulating fluidized bed reactor with a cooled return duct integrated in the cooled wall of the furnace. Especially, in this kind of arrangement, it is advantageous to have a cooled gas seal arranged to communicate with the furnace wall. U.S. Pat. No. 5,341,766 discloses a gas seal of a gill seal type meeting said requirements, which gas seal comprises a number of narrow gaps and is integrated directly in the furnace wall. Practice has proved that the usability of a gas seal of a gill seal type is generally good, but in some special situations, its operation capacity may decrease.

U.S. Pat. No. 5,526,775 discloses a gill seal type gas seal between a return duct and the upper part of a heat exchange chamber, which heat exchange chamber is closely connected to a reactor chamber wall. The heat exchange number is in flow communication with the reactor chamber through a vertical discharge channel and one or more openings. U.S. Pat. No. 4,716,856 discloses a heat exchange chamber arranged in a bent wall section of a reactor, where a return duct leads hot material in a fluidized bed in the heat exchange chamber.

SUMMARY OF THE INVENTION

An object of the present invention is to provide a method and an apparatus, in which the above mentioned problems of the prior art have been minimized.

It is especially an object of the present invention to provide a circulating fluidized bed reactor, which has a space-saving gas seal integrated in the planar cooled boiler wall, without reducing the bearing capacity thereof.

Further, an object of the invention is to provide a circulating fluidized bed reactor, which has a light, durable and reliable gas seal.

It is also an object of the present invention to provide a circulating fluidized bed reactor, in which the distribution of the bed material recycled from the gas seal has been improved in the direction of the wall of the receiving space.

In order to achieve these objects, a circulating fluidized bed reactor is provided, the characterizing features of which are discussed in more detail below.

Thus, it is a characteristic of the circulating fluidized bed reactor in accordance with the present invention that a gas seal is arranged in connection with a water tube wall defining a receiving space in such a way that the horizontal cross-sectional width of the lower part of the return duct measured in the direction of the first wall is larger than the depth perpendicular to said width, and the gas seal has a seal structure comprising water tubes joined to each other and being formed by bending water tubes from the water tube wall defining the receiving space.

In a simple case, the lower part of the return duct of the separator is in direct connection with the furnace, whereby, according to the present invention, a gas seal may be arranged in connection with the furnace wall. In some cases, however, the return duct is joined to the furnace via a separate heat exchange chamber in such a way that the heat exchange chamber is in gas flow connection with the furnace and the gas seal is arranged upstream of the heat exchanger. In this case, a gas seal in accordance with the present invention may be formed in connection with the wall of the heat exchange chamber, which is in gas flow connection with the furnace.

It is apparent to those skilled in the art that a gas seal in accordance with the present invention may also be arranged in connection with another comparable cooled wall defining a space in gas flow connection with the lower part of the furnace. The present invention is described below in more detail in connection with the furnace wall, but it is to be understood that the description above also involves gas seals in connection with the walls of other spaces in gas flow connection with the furnace of a circulating fluidized bed boiler.

The gas seal in accordance with the present invention preferably comprises at least one seal channel arranged in the lower end of the return duct, said channel being defined by a front wall and a seal structure, which separates a distinct portion from the bed of circulating material being formed in the lower part of the return duct. The seal channel is preferably in flow connection with the return duct only at the lower part of the seal structure, and only at the upper part of the front wall in flow connection with return means formed in the water tube wall defining the furnace.

When the lower edge of the means joining the seal channel to the furnace, i.e., the return means, is located higher up than the upper edge of the means joining the seal channel to the return duct, the seal channel comprises a center part, which is in a horizontal direction totally surrounded by walls, and a bed of circulating material is formed in the seal channel. The bed surface is substantially flush with the lower edge of the return means. Thus, the bed material in the seal channel prevents gas from flowing from the furnace to the return duct.

In order to make the bed material flow from the return duct through the seal channel to the furnace, the bed material in the seal channel is preferably fluidized by means of fluidizing gas, which is supplied through fluidization gas nozzles arranged in the lower part of the seal channel. Due to fluidization, the bed surface lies typically somewhat higher up in the seal channel than outside the seal channel in the lower part of the return duct. On the other hand, the friction caused by the bed material flow and the pressure difference prevailing between the furnace and the return duct tend to raise the bed surface in steady state conditions in the lower part of the return duct outside the seal channel.

In such cases where the fluidization of the seal channel is not necessary or it is very slow, the bed surface in the seal channel may be slightly inclined towards the front wall, whereby the gas lock is tight, even if the lower edge of the return means is approximately flush with or even slightly lower down than the upper edge of the means connected to the return duct.

Preferably, the seal structure comprises a side wall in connection with the front wall, said side wall being cooled by means of water tubes bent from the wall defining the furnace. Thereby, the water tubes may form a supporting structure for the side wall at the same time supporting the furnace wall and preventing return means formed on the wall from weakening the wall structure.

The seal structure preferably comprises two side walls, a rear wall and a roof portion. The flow means extending from the return duct to the seal channel may be formed in the lower part of the rear wall and/or at least one side wall. In addition to the side walls, even the rear wall and/or the roof portion of the seal structure may be cooled by the water tubes bent from the water tube wall defining the furnace.

The durability of the seal structure walls comprising water tubes may be increased by joining adjacent water tubes to each other by means of refractory material or by narrow metal plates, i.e., fins. Preferably, the water tubes of the walls and the fins between the water tubes are lined with refractory material to increase their wear resistance.

It is possible to bend the water tubes of the water tube wall defining the furnace to extend from the front wall to the side walls, then through the rear wall, or directly, to the roof portion, and finally back to the water tube wall defining the furnace. In this connection, the water tubes bent from the water tube wall also refer to tubes which are continuous with respect to the water flow, but separately bent to a desired form and thereafter, joined through welding to the water tubes in the furnace wall and their water circulation.

Preferably, the horizontal cross section of the seal channel is substantially rectangular, and the width thereof parallel to the first wall defining the furnace is at least approximately 1.5 times the depth perpendicular thereto. The width of the seal channel may be, for instance, two to three times its depth, or even more. The gas seal may also comprise at least two adjacent seal channels parallel to the first wall and in connection with the common return duct. Thereby, the total width of the seal channels is preferably at least about three times their depth. If necessary, the total width of the seal channels may even be equal to the width of the first wall, whereby the bed material circulating from the particle separator can be distributed throughout the whole width of the furnace quite evenly.

It is not necessary to divide the return system for bed material in accordance with the present invention, even if it is a very wide one, into separate sections by means of side walls. Preferably, the seal channel may also form a continuous space, whereby the water tubes bent from the furnace wall are used at the return means, e.g., for establishing the rear wall of the return unit or separate supporting structures for the seal channel. Especially, this kind of a wide seal channel is preferably provided with a number of return means. In some cases, it may be most preferable to use every other tube of the wall to cool and to support the seal structure of the gas seal and leave the rest of the tubes unbent or bend them only in close proximity of the furnace wall so as to form a large number of narrow return means.

The lower part of the return duct in accordance with the invention includes a seal channel of the gas seal and a down leg conducting bed material from the return duct down to the seal channel. These channels may be provided, when seen from the furnace, one after the other or side by side. In some cases, it is preferable to arrange the down leg and the seal channel side by side, as the extent of the lower part of the return duct from the furnace wall can thus be kept small and the supporting of the return duct is easy.

When it is especially important to distribute the recycled bed material evenly throughout the width of the furnace wall, it is advantageous to use several seal channels arranged side by side, when seen from the furnace. These seal channels may cover almost the whole area of the first furnace wall. Thereby, it is advantageous to provide a down leg in the gas seal, which down leg may be common to all seal channels and located subsequent to the seal channels when seen from the furnace.

In large circulating fluidized bed boilers having a plurality of particle separators, it is also natural to have several return ducts provided with gas seal arrangements. It is also possible to collect the material recycled from two separators in one return duct or to divide the material separated in one separator to flow into two return ducts, of which, for instance, only one leads to a separate heat exchange chamber. It is possible to apply the present invention to all these cases, thus effecting an even distribution of the material recycled to the furnace and keeping the bearing capacity of the furnace wall constant.

The return duct is preferably formed of planar water tube panels. Thus, one of the water tube walls forming the return duct may preferably be a section of the water tube wall defining the furnace. When using a gas seal structure in accordance with the present invention, the whole return duct may form an integrated unit with the furnace wall. The extension of the return duct wall on the furnace side may also form the rear wall of the seal channel, whereby the seal channel may be at least partially disposed between the extension of the return duct wall on the furnace side and the first wall defining the furnace.

The horizontal cross section of the lower part of the return duct is preferably rectangular and its width in the direction of the first wall is at least approximately twice the depth perpendicular thereto. The width of the cross section may preferably be, for instance, three or four times its depth, or even more.

The front wall of the seal channel in the gas seal is preferably shared by the furnace. The front wall may be a water tube structure provided with refractory lining, an uncooled metal structure lined with refractory material or a simple structure of refractory material. According to the present invention, at least one wall of the seal channel is preferably a water tube structure provided with refractory lining. The other walls of the seal channel may be refractory material provided with water tube structures, comparable metal structures or simple structures of refractory material.

A gas seal in accordance with the present invention preferably comprises at least two adjacent seal channels in communication with a common return duct. Adjacent seal channels may be totally independent or they may share common partition walls or form a space which is not divided at its upper and/or lower end. A seal channel may have side walls of its own, or the side walls of the lower part of the return duct may also partially act as side walls of the seal channel.

By applying the present invention, it is possible to provide a gas seal in connection with the furnace wall in such a way that the wall remains efficiently cooled and maintains its durability and may thus also act as a supporting structure in the furnace.

When the gas seal of the fluidized bed reactor is formed in connection with the cooled furnace wall without thick refractory linings, the outside dimensions of the gas seal are minimized and the weight of the gas seal remains moderate. Thus, the gas seal may be supported economically without large and expensive supporting structures. A cooled gas seal in accordance with the present invention is also durable and its temperature can be changed relatively quickly, for example, during start-ups and shutdowns without any damage to its structure.

The inner dimension of the seal channel cross section parallel to the front wall, i.e., the width, is larger, most preferably at least 1.5 times larger, than the inner dimension perpendicular thereto, i.e., the depth of the seal channel. When using an uncooled front and/or rear wall in the seal channel, the width measured in the direction of the furnace wall is to be quite small, preferably less than approximately 1000 mm, most preferably 300–500 mm. When using cooled front and rear walls, the width of the seal channel may be increased also by arranging local cooling, for example, in the middle of an otherwise uncooled wall. The width of the seal channel needs to be such that the furnace walls and seal channel walls remain sufficiently cooled and durable in every place.

The idea behind the present invention is that the circulating flow from the particle separator should be distributed evenly by means of a return duct integrated in the furnace wall throughout the whole furnace. The integration of the return duct in the furnace wall is optimized, with respect to space utilization and constructional strength, when the lower part of the return duct and the gas seal arranged therein are wide in the direction of the furnace wall and extend as slightly as possible outwards from the furnace. Thereby, the gas seal may preferably be realized in such a way that the supporting structures thereof are integrated in the supporting structures of the furnace wall.

As for the durability of the structure, it is advantageous to divide the wide gas seal in accordance with the present invention, at least in the area of the opening between the gas seal and the furnace, into compartments by special side walls, which are cooled by the water tubes of the furnace wall bent away from the area of the opening.

There are several methods to manufacture the gas seal in accordance with the invention. It is common to each of them that the pipes in the furnace wall are bent in such a way that openings required for recycling the circulation material are formed in the wall and the tubes bent from the furnace wall are utilized in the structure of the gas seal walls.

According to a first preferred embodiment, the tubes bent from the furnace wall are used primarily to form side walls for the seal channels in the gas seal. Thus, the tubes that are above and below the gas seal, adjacently in the furnace wall, are at the level of the gas seal subsequently in the space between the front wall and the rear wall, whereby the plane they form is at least approximately perpendicular to the furnace wall.

This kind of a structure is simple to manufacture and it may be realized in such a way that the bed material flow in the seal channel is fluent and the bearing capacity of the furnace wall does not substantially decrease. When this structure is used, the rear wall of the seal channel is preferably an uncooled structure provided with refractory lining.

According to another preferred embodiment, the front wall, the side walls and the roof portion are cooled by water tubes bent from the water tube walls of the furnace. By leaving the lower parts of the side walls of the seal channels uncooled or open, it is possible to cool the front wall of the seal channel substantially efficiently throughout its whole area.

According to a third preferred embodiment, tubes of the furnace wall are used for forming a front wall, side walls, a rear wall and a roof portion of the seal channel. When the lower parts of the side walls are left open, it is possible to cool all seal channel walls efficiently by means of the water tubes of the furnace wall.

BRIEF DESCRIPTION OF THE DRAWINGS

The present invention is discussed below in more detail, by way of examples, with reference to the accompanying drawings, in which FIG. 1 schematically illustrates a vertical cross section of a circulating fluidized bed reactor provided with a gas seal in accordance with the present invention.

DESCRIPTION OF THE PREFERRED EMBODIMENTS

Figure 1:
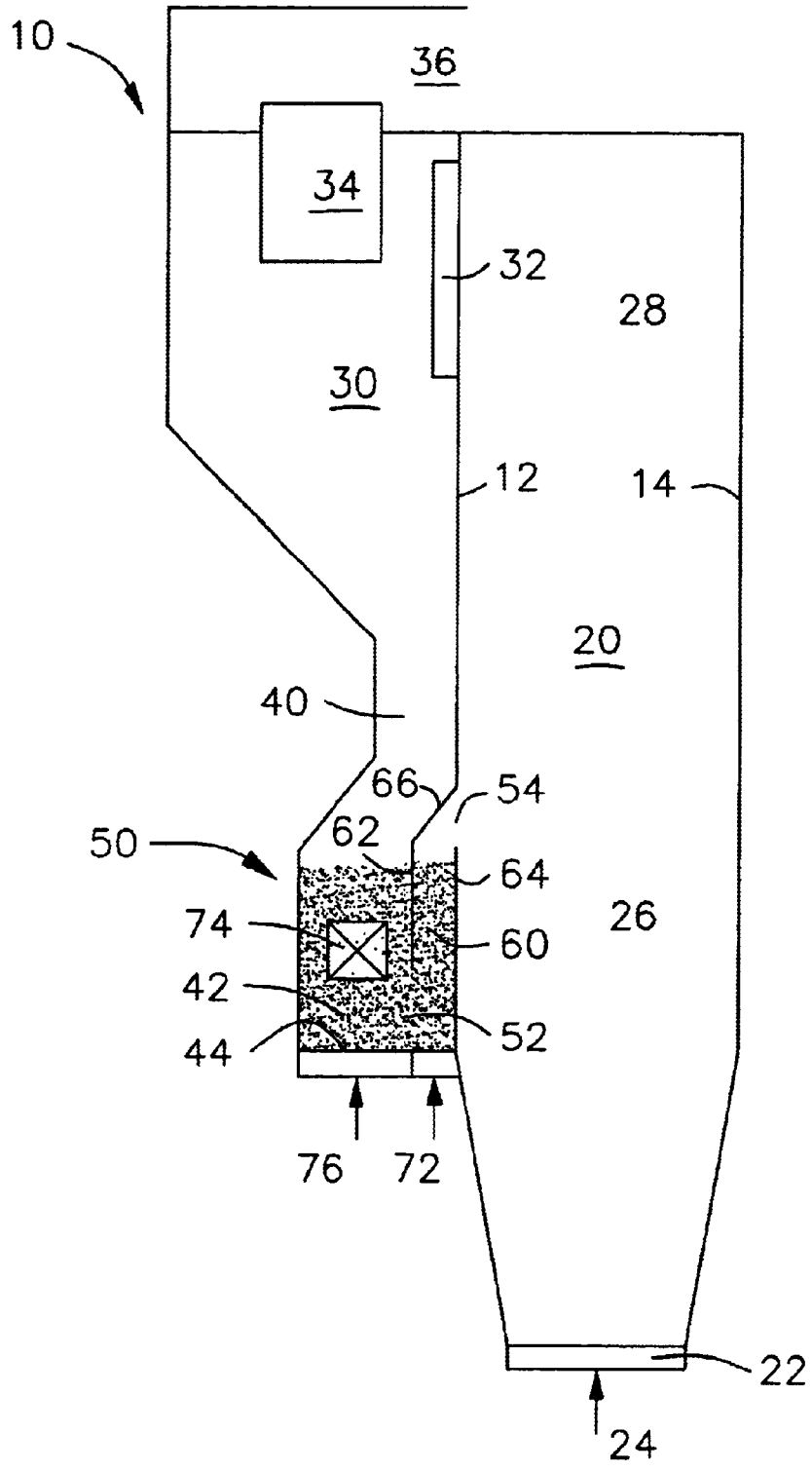

FIG. 1 schematically illustrates a vertical cross section of a circulating fluidized bed reactor 10, which has a gas seal 50 in accordance with the present invention. The circulating fluidized bed reactor 10 comprises a furnace 20 defined by water tube walls 12, 14, in which furnace bed material is fluidized by fluidizing gas 24 to be supplied through a grid 22. The fluidizing gas flowing upwards in the furnace 20 and the flue gas formed in the reactor 10 entrain bed material through a conduit 32 arranged in the upper part 28 of the furnace 20 to a particle separator 30. The gases exit from the particle separator 30 through an outlet tube 34 to a convection part 36 and the separated particles to the gas seal 50 via a return duct 40.

The gas seal 50 comprises a seal structure, the rear wall 62 and the roof portion 66 of which are disclosed in FIG. 1, a seal channel 60 separated from the lower part of the return duct 40 and a down leg 42 conducting bed material downwards. The lower part of seal channel 60 is through an opening 52 in connection with the down leg 42 and its upper part through a return opening 54 in connection with the lower part 26 of the furnace 20. The lowest point of the return opening 54 is usually located higher up than the highest point of the opening 52, so that a bed material column is established, when bed material is recycled through the gas seal 50 to the down leg 42 and the seal channel 60. The column prevents gas from flowing from the lower part 26 of the furnace 20 directly to the return duct 40.

The rear wall 62, the common front wall 64 shared with the furnace and the roof portion 66 define the seal channel 60. The seal channel 60 is also defined by side walls, which are not shown in FIG. 1. If the lower part of the return duct 40 is relatively narrow, the side walls thereof, which are not shown in FIG. 1, may at the same time act as side walls of the seal channel 60. The opening 52 is formed by leaving the lower edge of the rear wall 62 higher up than the bottom level 44 of the return duct 40.

In order to maintain the bearing capacity of the wall 12, the return opening 54 is preferably relatively narrow. The gas seal 50 of one return duct 40 is preferably provided with more than one seal channel 60 and at least one side wall of the seal channels 60 is not a side wall of the return duct 40. This kind of a seal channel side wall, not being a side wall of the return duct 40, may reach the bottom level 44 of the return duct 40, or its lower edge may be located higher up, preferably approximately flush with the lower edge of the rear wall 62.

According to the present invention, at least the side wall of the sea channel 60 in the gas seal 50 comprises water tubes bent from the water tube wall 12 of the furnace 20. The advantage of the arrangement in accordance with the invention is based on the fact that at the same time as water tubes are bent away from the wall 12 to form a return opening 54, the side wall of the seal channel 60 in the gas seal 50 is cooled and reinforced. The water tubes may be distributed in the side wall of the seal channel 60 nearly evenly, or they may be concentrated in a particular way, for example, close to the front wall 64. Based on the geometry of each application, it can be determined, whether it is preferable to use water tubes bent from the wall 12 even in the rear wall 62 and in the roof portion 66, in addition to the side walls.

In order to make the bed material flow in the seal channel 60, fluidizing air 72 is preferably supplied to the seal channel 60 through its lower part. Preferably, the seal channel 60 or the down leg 42 of the gas seal, as shown in FIG. 1, may also be provided with heat exchanger surfaces 74. Fluidizing air 76 may be supplied also to the down leg 42.

Figure 2:
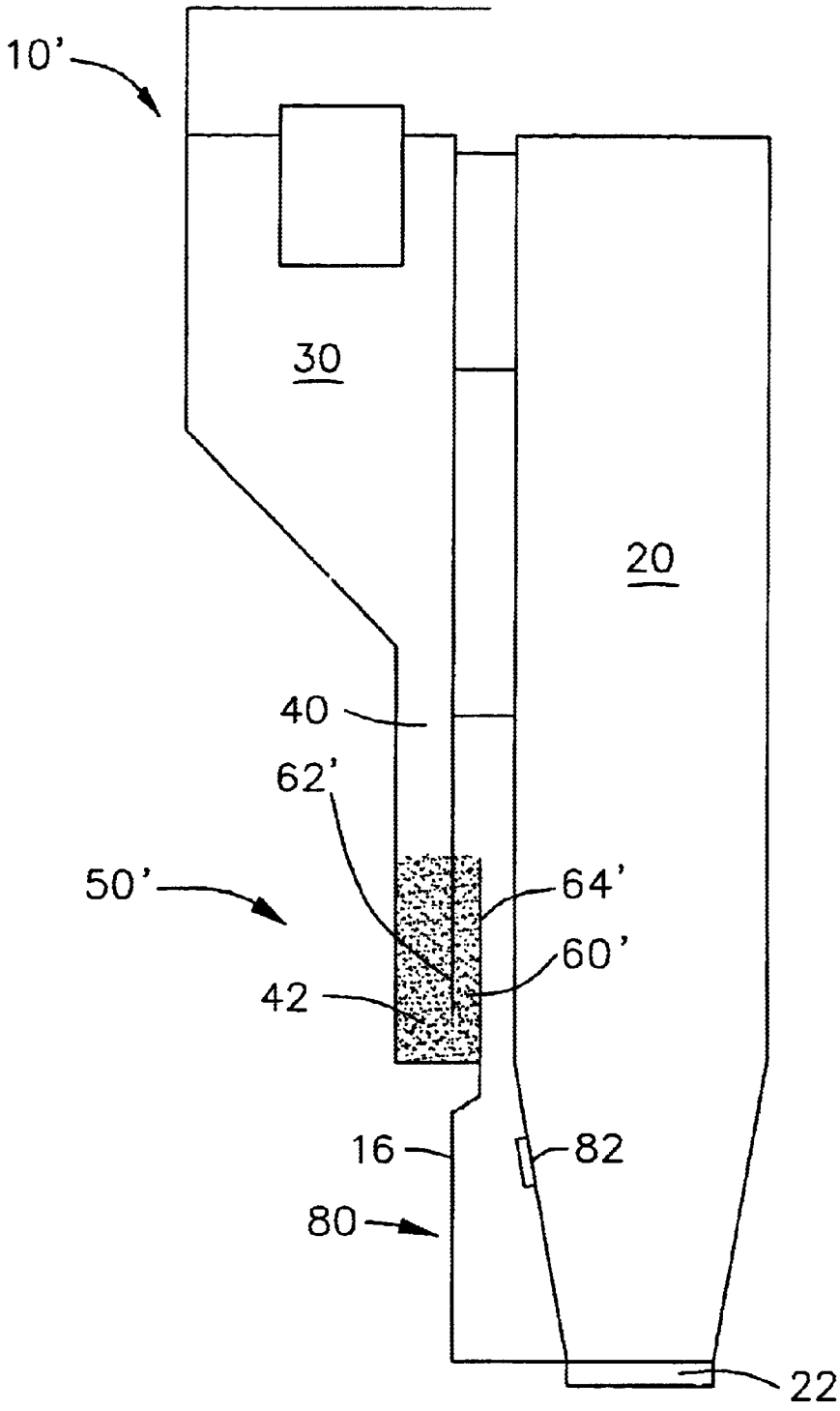
FIG. 2 schematically illustrates a vertical cross section of a second circulating fluidized bed reactor provided with a gas seal in accordance with the present invention.

FIG. 2 schematically illustrates a vertical cross section of a second circulating fluidized bed reactor 10', in which the lower part of the return duct 40 is provided with a gas seal 50' in accordance with the present invention. The circulating fluidized bed reactor 10' illustrated in FIG. 2 differs from the circulating fluidized bed reactor 10 of FIG. 1 in that the reactor 10' is provided with a heat exchange chamber 80 in gas connection through an opening 82 with the lowest part 26 of the furnace 20. The gas seal 50' between the return duct 40 connected to the particle separator 30 and the heat exchange chamber 80 is formed in such a way that the seal channel side wall of the gas seal 50' comprises water tubes bent from the wall 16 of the heat exchange chamber 80.

The gas seal 50' illustrated in FIG. 2 differs from the gas seal 50 of FIG. 1 in that the circulating material does not fall on top of the roof portion of the seal channel 60', but directly down to the leg 42. In the arrangement, a straight extension of the wall 16 forms the rear wall 62' of the seal channel 60' and the tubes bent from the wall 16 towards the furnace wall 12 extend upwards in the seal channel front wall 64' and the side walls thereof, which are not shown in FIG. 2.

Similarly to the wall of FIG. 1, the wall 16 in FIG. 2 is preferably a supporting wall extending approximately from the level of the grid 22 to the furnace roof. Initially, the wall 16 forms the wall of the heat exchange chamber and later on, above the gas seal 50', the wall of the return duct 40 and finally, the wall of the particle separator. The gas seal 50' arrangement in accordance with the present invention may preferably be realized in such a way that the supporting wall 12 or 16 substantially maintains its bearing capacity when openings, sufficiently large for particle circulation, are arranged in the wall 12 or 16. At the same time, the tubes bent from wall 12 or 16 cool and reinforce the seal structure of the gas seal 50 or 50'.

Figure 3:
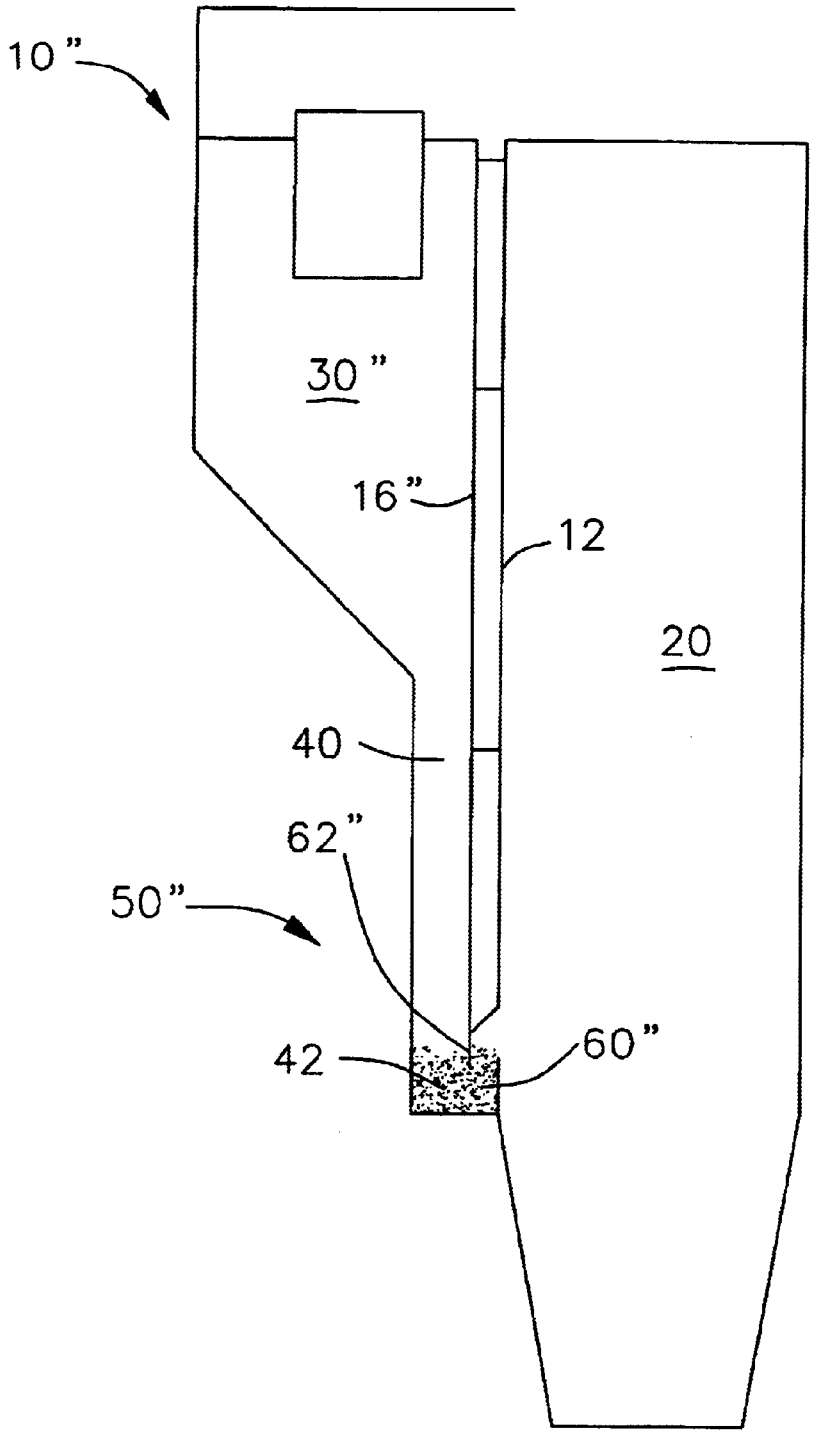
FIG. 3 schematically illustrates a vertical cross section of a third circulating fluidized bed reactor provided with a gas seal in accordance with the present invention.

FIG. 3 schematically illustrates a vertical cross section of a third circulating fluidized bed reactor 10", in which the lower part of return duct 40 is provided with a gas seal 50" in accordance with the present invention. The circulating fluidized bed reactor 10" disclosed in FIG. 3 differs from the circulating fluidized bed reactor 10 disclosed in FIG. 1 in that the wall on the particle separator 30" side of the furnace 20 has a double structure 12, 16", and the seal channel 60" of the gas seal is formed in the space in the middle thereof. Since, in the arrangement in accordance with FIG. 3, the lower part of the wall 16" of the particle separator 30 and of the return duct 40 forms the rear wall 62" of the seal structure, the tubes bent from the furnace wall 12 of the furnace 20 can preferably be used for forming side walls for the seal channel 60".

Figure 4:
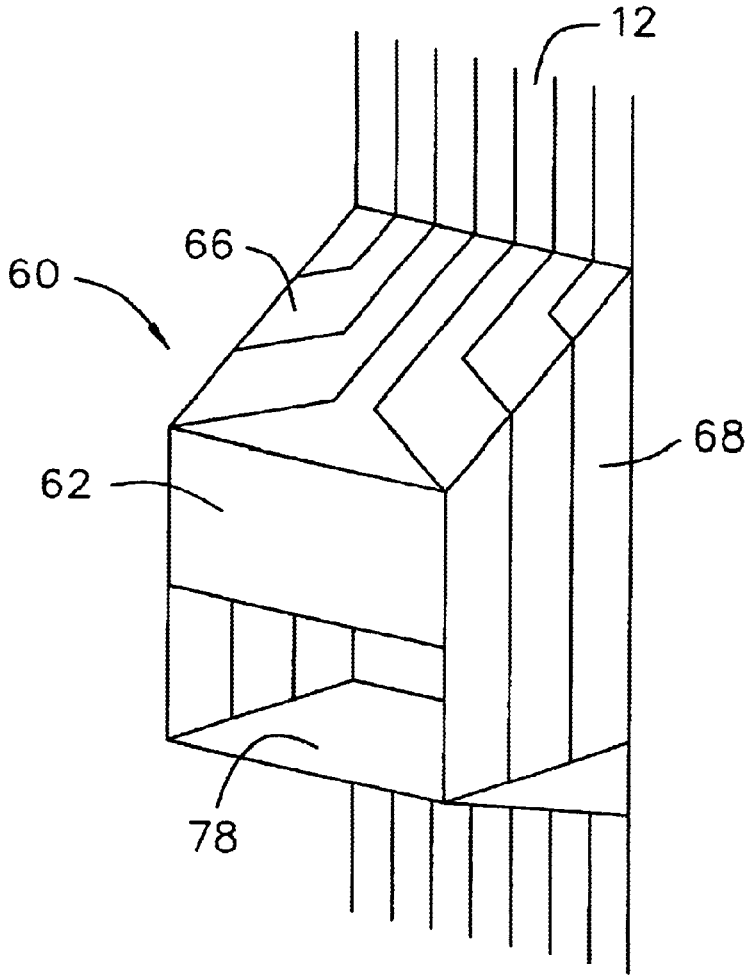
FIG. 4 schematically illustrates an axonometric rear view of the seal channel in a gas seal in accordance with a first preferred embodiment of the invention.

FIG. 4 schematically illustrates an axonometric rear view of an arrangement of water tubes bent from the furnace wall 12 of the gas seal channel 60 in accordance with a first embodiment of the present invention. In FIG. 4, as well as in FIGS. 7 and 8, the thick lines illustrate how the water tubes run in connection with the seal channel 60 and the thin lines show the outlines of the structures provided with refractory lining.

FIG. 4 schematically shows the roof portion 66 of the seal channel, the rear wall 62, one of the side walls 68 and partially, the lower part 78. The figure shows how the water tubes, when seen from top to bottom, are first bent parallel to the roof portion 66, then further flush with the roof portion towards the side walls, of which only one side wall 68 is shown. Although not shown in FIG. 4 for the sake of clarity, it is apparent to anyone skilled in the art, how the water tubes can, again, in the lower part 78 be bent adjacently in the wall 12.

The water tubes are preferably provided with refractory lining throughout the whole seal channel 60. Since, in the embodiment in accordance with FIG. 1, the bed material falling from the return duct 40 hits the upper surface of the seal channel roof portion, the roof portion needs to be durable enough. The roof portion is usually made inclined to avoid the formation of deposits. Thereby, the water tubes can be bent from the side walls 68 upwards to the wall 12, along the roof portion 66, and yet be kept continuously rising, as is required by trouble-free water vaporization.

Because the upper surface of the lower part 78 is usually made approximately horizontal, the refractory floor in the lower part needs, preferably, to be so thick that the water tubes inside the refractory floor of the lower part can be bent as continuously rising from the level of the lower part of wall 12 to the level of the side walls.

All the tubes bent from the furnace wall 12 are arranged so as to run along the side walls of the seal channel 60, and therefore, the rear wall 62 of the seal channel 60 shown in the figure and the front wall of the seal channel 60, which is not shown, are uncooled metal structures provided with refractory lining or simple refractory structures. An uncooled structure is durable, when its width is sufficiently small and it is supported against cooled structures. FIG. 4 does not show other walls defining the lower part of the return channel nor nozzles, by means of which air is supplied to the lower part of the seal channel 60.

Figure 5:
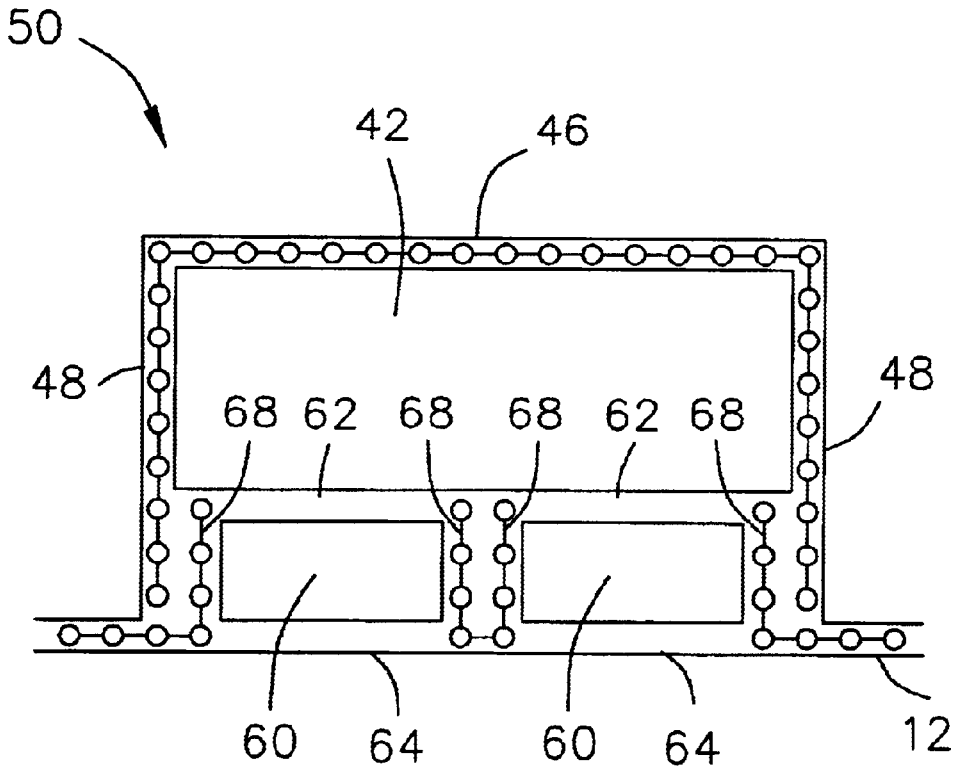
FIG. 5 schematically illustrates a horizontal cross section of the gas seal in accordance with the present invention.

FIG. 5 schematically illustrates a horizontal cross section of the gas seal 50 in accordance with a first preferred embodiment taken between seal channel openings 52 and 54. FIG. 5 shows two similar seal channels 60 having front walls 64 and rear walls 62 of refractory material. The side walls 68 of the seal channels are reinforced by water tubes bent from the furnace wall 12. Further, side walls 48 and a rear wall 46 defining the lower part of the return duct 40 and the down leg 42 are shown around the seal channel 60. The water tubes in the walls 46 and 48 are preferably not bent from the water tubes of the wall 12, but constitute a separate section of the steam generation system of the boiler.

Naturally, the number of seal channels 60 in the embodiment in accordance with FIG. 5 may also be one, or even more than two. As the tubes bent to the side walls 68 support even the wall 12, it is not necessary to leave special wall sections consisting of unbent water tubes between the seal channels 60, but seal channels 60 can be arranged almost throughout the whole width of the wall 12, if necessary. Thus, the circulating material may be spread as evenly as possible throughout the whole width of the furnace wall.

Figure 6A:
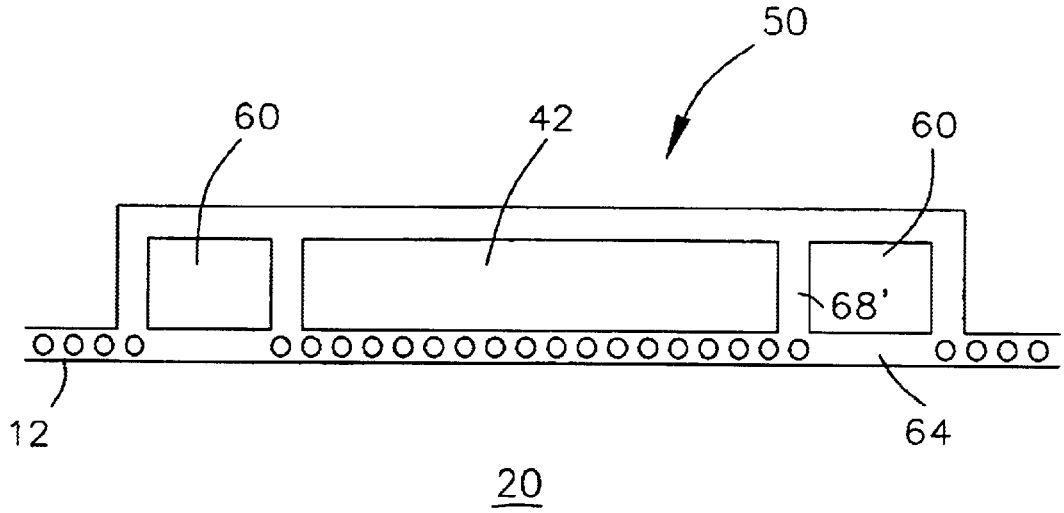
FIG. 6*a* schematically illustrates an alternative cross section of the gas seal in accordance with the first preferred embodiment of the present invention.

FIG. 6*a* illustrates an alternative of the embodiment in accordance with FIG. 5, in which the down leg 42 is located between two seal channels 60 arranged abreast, parallel to the wall 12. As the tubes of the wall 12 are not bent at the channel 42 and run upwards, the bearing capacity of the wall 12 in the embodiment of FIG. 6*a* is even better maintained than in the embodiment of FIG. 5.

Figure 6B:
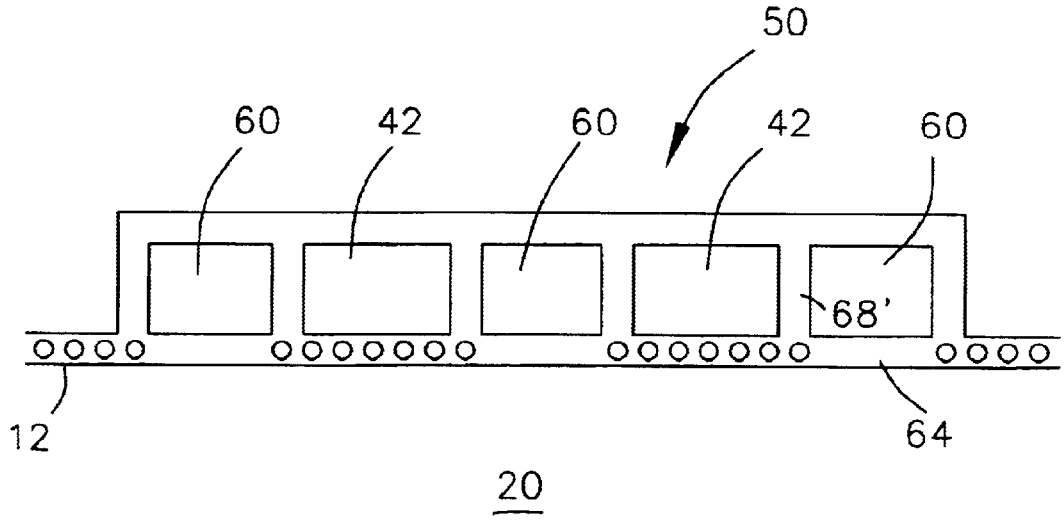
FIG. 6*b* schematically illustrates a second alternative cross section of the gas seal in accordance with the first preferred embodiment of the present invention.

FIG. 6*b* illustrates an alternative of the embodiment in accordance with FIG. 5, in which the lower part of the return duct 40 is divided into two down legs 42 arranged between the three seal channels 60 abreast in the direction of the wall 12. The returning of the bed material to the furnace 20 taking place at the front walls 64 of the seal channels 60 is more homogeneous in the arrangement in accordance with FIG. 6*b* than in that of FIG. 6*a*.

FIGS. 6*a* and 6*b* do not show water tubes bent from the wall 12, as it is possible to conduct them through the gas seal walls in many different ways. One preferred method is to cool all the inner walls of the gas seal by the tubes of the wall 12, i.e., the side walls 68' on the down leg side of the seal channels 60. The cooling tubes of the outer walls of the gas seal 50 may then continue as cooling tubes of the return duct 40. Naturally, the present invention also covers comparable embodiments, in which the number of the seal channels 60 and down legs is different from those given in these examples.

Figure 7:
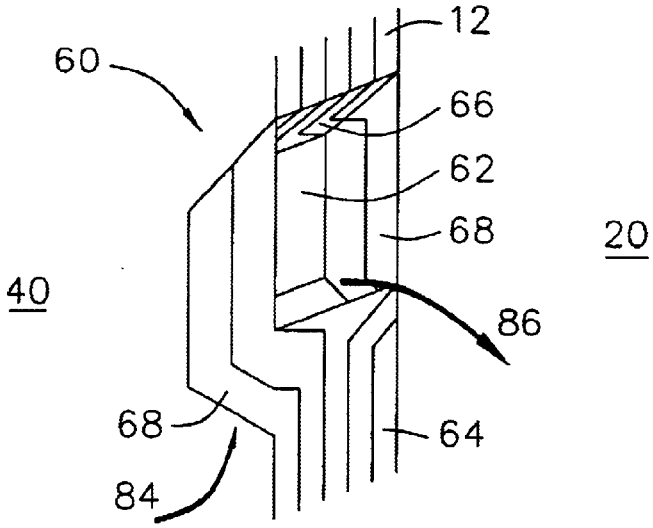
FIG. 7 schematically illustrates an axonometric front view of the seal channel of the gas seal in accordance with a second preferred embodiment of the invention.

FIG. 7 schematically illustrates an axonometric front view of an arrangement, in accordance with a second preferred embodiment of the invention, of water tubes bent from the furnace wall 12 to form gas seal channel 60. The flow of circulating bed material 84 from the return duct 40 enters the lower part of the seal channel 60 from below the rear wall 62 and the side walls 68. The bed material flow 86 from the upper part of the seal channel 60 passes over the wall 64 to the furnace 20.

In the arrangement in accordance with FIG. 7, the lower parts of the side walls 68 containing water tubes bent from furnace wall 12 extend only to the level of the lower edge of the rear wall 62. In the arrangement in accordance with FIG. 7, the water tubes bent from the furnace walls 12 run, seen from bottom to top, from the section of the wall 12 comprising the front wall 64 to the side walls 68 and from there onwards through the roof portion 66 back to the furnace wall 12. The arrangement in accordance with FIG. 7 differs from the arrangement in accordance with FIG. 4 in that the front wall 64 is efficiently cooled.

Figure 8:
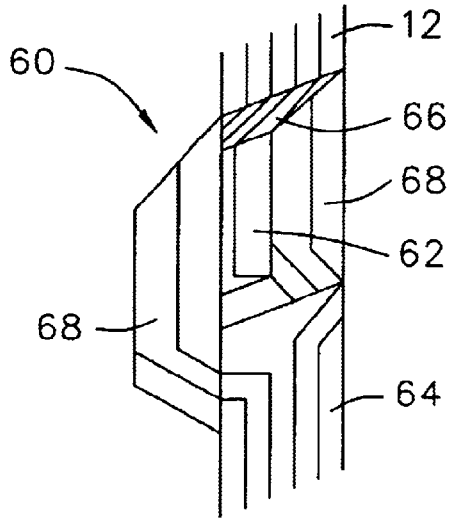
FIG. 8 schematically illustrates an axonometric front view of the seal channel of the gas seal in accordance with a third preferred embodiment of the invention.

FIG. 8 schematically illustrates an axonometric front view of an arrangement, in accordance with a third preferred embodiment of the invention, of water tubes bent from the furnace wall 12 to form the gas seal channel 60. The arrangement in accordance with FIG. 8 differs from the arrangement of FIG. 7 in that some of the tubes bent from the front wall 64 to the side walls 68 continue to the rear wall 62, whereas others rise along the side wall 68 up to the roof portion 66. In the arrangement in accordance with FIG. 8, each seal channel wall is cooled and reinforced by water tubes bent from furnace wall 12.

In the above, the present invention has been described in connection with embodiments that are presently considered as the most preferable, but it is to be understood that the invention is not limited to these embodiments, but it also covers a number of other embodiments within the scope of the patent claims below.

We claim:

1. A circulating fluidized bed reactor, comprising:

a furnace, a lower part of which is provided with fluidizing gas nozzles for fluidizing bed material to be fed to the furnace, the furnace being defined by a substantially vertical and planar first wall;

a particle separator for separating bed material from the gas discharged from the reactor;

a return duct for bed material separated in the particle separator, arranged in connection with said first wall, and having a lower part;

a gas seal arranged in the lower part of the return duct, preventing gas from flowing from the furnace to the return duct; and a receiving space defined by a planar water tube wall, which receiving space may comprise the furnace, whereby the water tube wall is the first wall, or a space in gas flow connection with the furnace, wherein the gas seal (i) is arranged in connection with the water tube wall defining the receiving space in such a way that a horizontal cross-sectional width of the lower part of the return duct measured in the direction of the first wall is larger than the depth perpendicular to the width and (ii) has a seal structure comprising water tubes joined to each other and formed by bending water tubes from the water tube wall defining the receiving space.

2. A circulating fluidizing be reactor according to claim 1, wherein the seal structure separates a distinct portion from the bed of circulating material being formed in the lower part of the return duct and forms a seal channel, defined by the seal structure, the lower part of which is provided with flow means connected to the return duct, and a substantially vertical front wall, the upper part of which is in flow connection with return means formed in the water tube wall defining the receiving space.

3. A circulating fluidized bed reactor according to claim 2, wherein the seal structure comprises a side wall connected to the front wall, and the water tubes in the water tube wall defining the receiving space are bent to cool the side wall and to form a supporting structure for the side wall.

4. A circulating fluidized bed reactor in accordance with claim 3, wherein the seal structure comprises water tubes joined to each other, bent from the water tubes in the water tube wall defining the receiving space, supporting the water tube wall and preventing the return means from weakening the water tube wall.

5. A circulating fluidized bed reactor in accordance with claim 3, wherein the seal structure comprises two side walls, a rear wall and a roof portion.

6. A circulating fluidized bed reactor in accordance with claim 5, wherein the lower part of the rear wall is in flow connection with the return duct.

7. A circulating fluidized bed reactor in accordance with claim 5, wherein a portion of water tubes in the water tube wall defining the receiving space is bent to extend from the front wall to the side wall and therefrom, via the roof portion, back to the water tube wall defining the receiving space.

8. A circulating fluidized bed reactor in accordance with claim 5, wherein a portion of water tubes in the water tube wall is bent to extend from the front wall to the side wall and therefrom, via the rear wall and the roof portion, back to the water tube wall defining the receiving space.

9. A circulating fluidized bed reactor in accordance with claim 3, wherein the horizontal cross section of the seal channel is substantially rectangular and the width measured in the direction of the first wall is at least 1.5 times the depth perpendicular to the width.

10. A circulating fluidized bed reactor in accordance with claim 3, wherein the gas seal comprises at least two adjacently disposed seal channels parallel to the first wall and in communication with a common return duct.

11. A circulating fluidized bed reactor in accordance with claim 10, wherein the total width of the adjacent seal channels is at least approximately three times their depth.

12. A circulating fluidized bed reactor in accordance with claim 3, wherein the lower part of the return duct is provided, in the direction of the first wall defining the furnace, with a seal channel of the gas seal abreast of a down leg conducting bed material from the particle separator to the seal channel.

13. A circulating fluidized bed reactor in accordance with claim 3, wherein the return duct is formed of planar water tube panels.

14. A circulating fluidized bed reactor in accordance with claim 13, wherein an extension of the wall on the furnace side of the return duct forms the rear wall of the seal channel.

15. A circulating fluidized bed reactor in accordance with claim 13, wherein the seal channel is at least partially arranged between the extension of the wall on the furnace side of the return duct and the first wall defining the furnace.

16. A circulating fluidized bed reactor in accordance with claim 13, wherein one of the water tube walls forming the return duct is a section of the first wall defining the furnace.

17. A circulating fluidized bed reactor in accordance with claim 3, wherein the horizontal cross section of the lower part of the return duct is rectangular and its width measured in the direction of the first wall is at least approximately twice the depth perpendicular thereto.

* * * * *